United States Patent [19]

Cremer

[11] Patent Number: 5,052,320

[45] Date of Patent: Oct. 1, 1991

[54] EMERGENCY TILLER FOR OUTBOARD MOTORS

[76] Inventor: David F. Cremer, Post Office, Naples Main Office, 1200 Goodlette Rd., Naples, Fla. 33941

[21] Appl. No.: 542,928

[22] Filed: Jun. 25, 1990

[51] Int. Cl.[5] ..... B63H 21/26

[52] U.S. Cl. ..... 114/146; 16/114 R; 114/153; 440/63; 440/900

[58] Field of Search ..... 114/146, 153; 440/53, 440/63, 900; 74/544; 248/206.3, 206.4, 205.6, 230, 231; 16/114 R, 114 A, 114 B

[56] References Cited

U.S. PATENT DOCUMENTS

| | | | |
|---|---|---|---|
| 2,624,212 | 1/1953 | Urquhart | 440/63 |
| 2,899,833 | 8/1959 | Prier | 114/146 |
| 3,274,849 | 9/1966 | Hanson | 74/544 |
| 3,288,099 | 11/1966 | Bittner | 114/153 |
| 3,295,810 | 1/1967 | Kintish | 248/206.4 |
| 3,420,203 | 1/1969 | Ambrosh | 114/153 |
| 3,750,621 | 8/1973 | Hoyt | 440/63 |
| 4,130,079 | 12/1978 | Rhorer et al. | 114/153 |
| 4,515,567 | 5/1985 | Wilson | 114/153 |
| 4,573,930 | 3/1986 | Queen | 440/63 |
| 4,624,206 | 11/1986 | Frye et al. | 74/544 |
| 4,735,166 | 4/1988 | Dimalanta | 114/146 |

FOREIGN PATENT DOCUMENTS

| | | | |
|---|---|---|---|
| 982545 | 1/1976 | Canada | 440/63 |
| 2057379 | 4/1981 | United Kingdom | 440/53 |

*Primary Examiner*—Sherman D. Basinger
*Assistant Examiner*—Thomas J. Brahan
*Attorney, Agent, or Firm*—William F. Hamrock

[57] ABSTRACT

The invention is directed to an emergency tiller mechanism for an outboard motor movable about a steering axis by a tiller steering arm attached thereto. The emergency tiller mechanism comprises a durable, flexible flat pad having backing of non-slip material, which firmly cushions a plate to a side or a top surface of the motor housing, and a compressible rubbery top. The plate and pad are secured to the motor housing by a pair of strong, durable non-slip straps tightened around the motor and plate. A hollow support socket is secured to the outer surface of the plate into which the tiller steering arm is secured. The tiller arm extends horizontally within the cockpit of the boat.

23 Claims, 6 Drawing Sheets

FIG. 8c
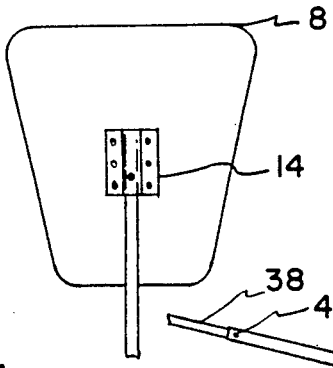
FIG. 8a
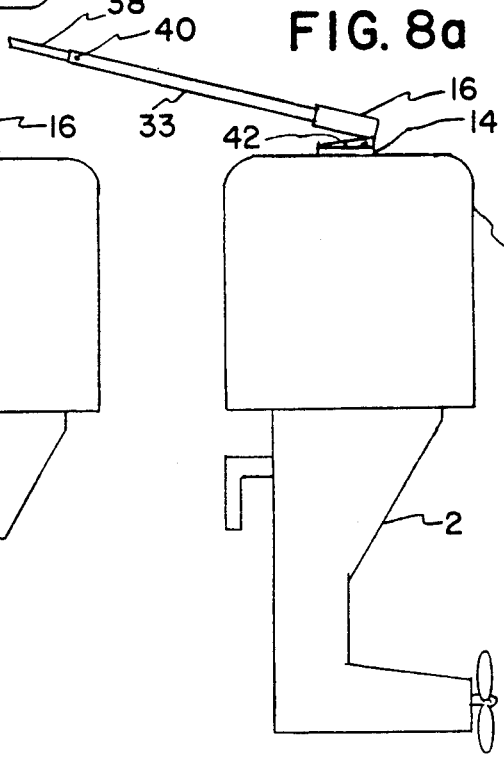
FIG 8b
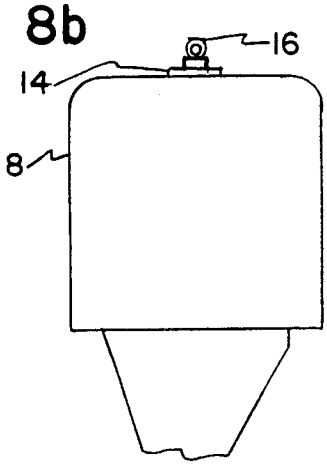
FIG. 9c
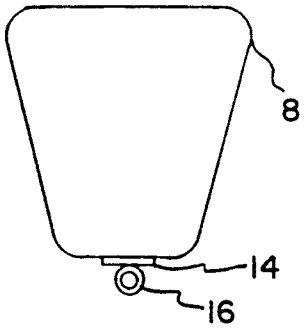
FIG. 9c
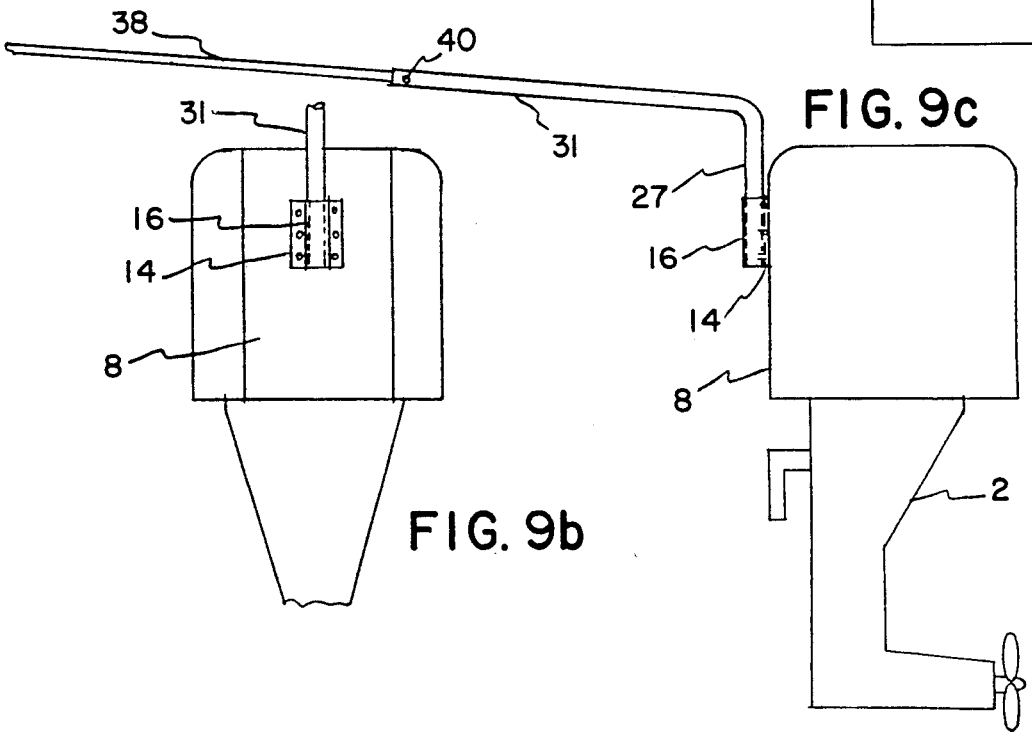
FIG. 9b

EMERGENCY TILLER FOR OUTBOARD MOTORS

BACKGROUND OF THE INVENTION

1. Field of the Invention

The invention relates to an emergency steering mechanism for outboard motors and, more particularly, to a tiller steering mechanism for attachment to outboard motors which provides an emergency steering mechanism when the regular system fails.

2. Description of the Prior Art

There is a problem in the prior art in producing suitable means for steering an outboard motor operated boat when its steering system fails. Usually the failure is due to non-functioning of the cable or hydraulic steering system caused by breaking or binding of the cable, or breaking or leaking of the hydraulic hose, or failure of the hydraulic pump, or other similar problem. The result is that the boat becomes unsteerable which places the boat, its operator and passengers in an extremely dangerous situation. This is especially so if there is no assistance immediately available such as by radio or by being towed by another boat. In some situations, it could be possible to steer the boat by manually turning the outboard motor if a person is able to reach over it and bodily embrace it. However, when one is "hugging" the motor in attempting to steer the boat, there is the danger of falling overboard and possibly being cut by the propeller and/or drowning.

In reviewing the prior art in this area, U.S. Pat. No. 4,480,571 to Meyer is directed to a supplemental steering system which has several disadvantages. It cannot be used universally because not all outboard motors have a tiller arm #24 which is an essential component of Meyer's system. Even if a tiller arm #24 is present, not all tiller arms include two holes to coincide with Meyer's apertures #32 and #33 Also, splash well #14 on many boats is so narrow and the transom so low that it creates the problem of being hit by Meyer's steering system upon tilting of the motor thereby impeding the steering operation. Further, the limited space in a boat's motor splash well is usually substancially taken up by equipment which could impede the movement of connecting link #30 so as to cause difficulty in steering from side to side. A further difficulty with Myers is created by being required to remove the regular steering system before attaching the Meyer's system which usually requires special tools especially if parts are corroded. Another problem is that in some boats the motor is too far extended beyond the aft of the boat that it would require a longer Meyer steering arm than that of Meyers thereby considerably reducing the steering efficiency of the boat. Also, it is to be noted that Meyer's steering arm #40 could be detached by the operator easily such as due to rough water and result in the operator losing control of the boat. Further, in rough water, it would be extremely difficult to disconnect the regular steering system and connect Meyer's system to the tiller arm. Another difficulty is that the thin flat handle #44 of Myers is extremely hard on the operator's hands.

Thus a need exists for an emergency tiller for attachment to outboard motors which overcomes the many problems of the prior art.

SUMMARY OF THE INVENTION

The primary object of the present invention is to provide an emergency tiller for outboard motors which is safe, quick and easy to install and easy to operate.

Another object of the invention is to provide an emergency tiller which is firmly secured to the motor without tools and will not be easily separated therefrom.

A further object of the invention is to provide an emergency tiller which is inexpensive, durable and easy to store.

A further object of the invention is to provide an emergency tiller which can be used on almost all outboard motors.

A further object of the invention is to provide an emergency tiller designed so that movement of its component parts are not impeded by striking areas of the boat.

Briefly stated, the invention is directed to an emergency tiller mechanism for an outboard motor movable about a steering axis by a tiller steering arm attached thereto. In one embodiment, the emergency tiller mechanism comprises a durable, flexible flat pad having backing of non-slip durable material, which firmly cushions a plate to a side or top surface of the motor housing, and a compressible rubbery top. The plate and pad are secured to the motor housing by a pair of strong, durable, non-slip straps tightened around the motor and plate. A hollow support socket is secured to the outer surface of the plate into which the tiller steering arm is secured.

In one embodiment, the plate and pad are strapped on the top of the motor housing and the tiller arm is secured within the socket and extends horizontally within the cockpit of the boat. In another embodiment, the plate and pad are strapped to the forward side of the motor housing from which a vertical arm component of the tiller extends upwardly from the socket and bends horizontally into the cockpit of the boat. The vertical arm component and horizontal tiller arm may also be two separate tiller arm components secured at their joined ends. A further embodiment includes the vertical arm component thereof being adjustably secured within the socket.

Other embodiments of the invention include directly securing the support socket to the motor housing either on the top or side of the motor. Further embodiments include having the original motor housing being fabricated with the support socket embedded, molded or otherwise secured therein.

A further embodiment of all of the above includes an extension arm which may be adjustably attached to the end of the horizontal tiller arm. Such an extension tiller arm is particularly required on boats wherein the outboard motor is mounted considerably aft of the boat's transom whereby an extra long tiller is required.

BRIEF DESCRIPTION OF THE DRAWINGS

FIGS. 8*a*, *b* and *c* are views of an embodiment of the plate attached to the top of the motor housing.

FIGS. 9*a*, *b* and *c* are views of an embodiment of the plate attached to the forward side of the motor housing.

DESCRIPTION OF THE PREFERRED EMBODIMENTS

This invention does not require detaching the regular cable or hydraulic steering system unless the regular system is jammed or frozen tight to prevent the motor from turning. In these cases, a cable or hydraulic steering system usually must be detached from the outboard motor to permit the motor to rotate freely. These steering systems are generally attached to the motor by means of only one pin, nut or bolt which when removed will detach the motor from the cable steering system. Hydraulic steering systems can also be detached by relieving the hydraulic pressure by opening a valve or removing a hose.

Figure 1:
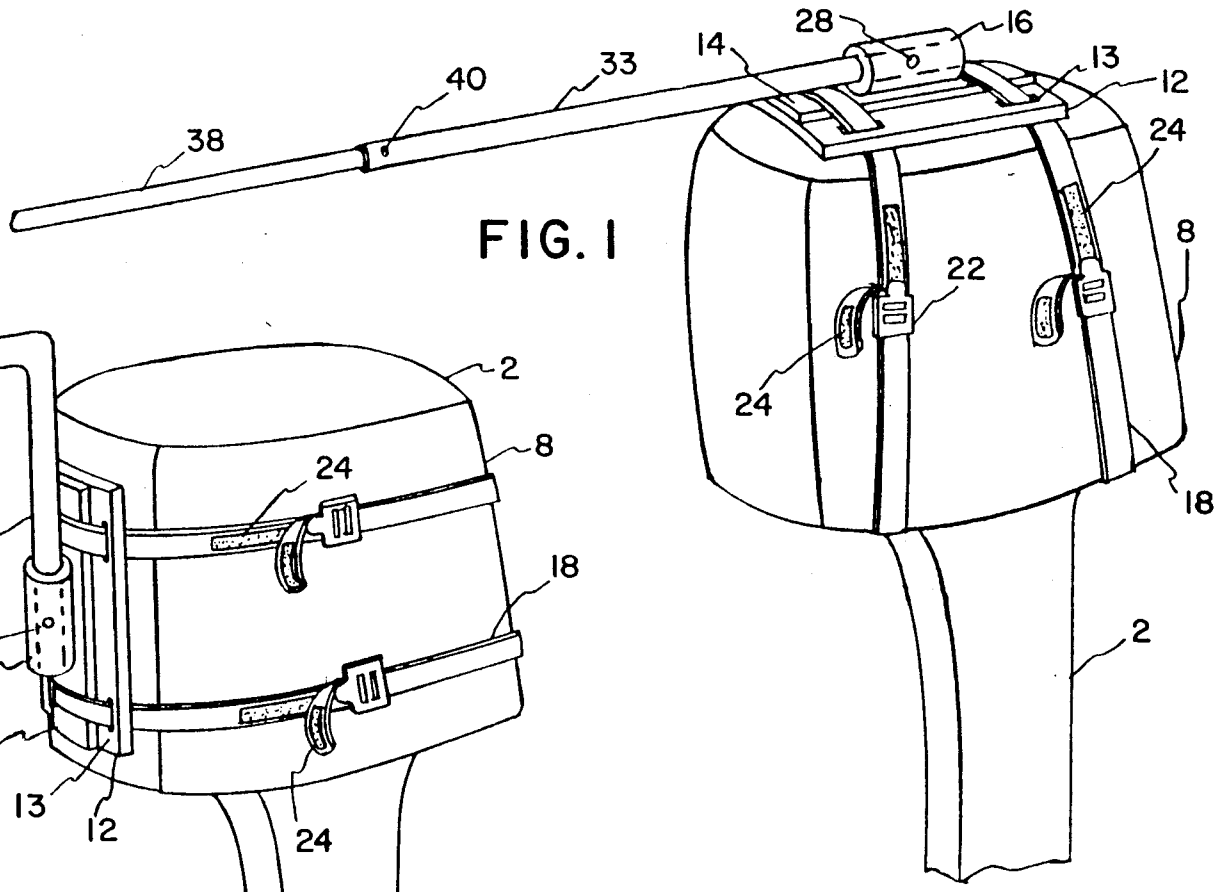
FIG. 1 is a view of an embodiment wherein the emergency tiller mechanism is strapped to the top wall of the motor housing.
Figures 2A, 2B:
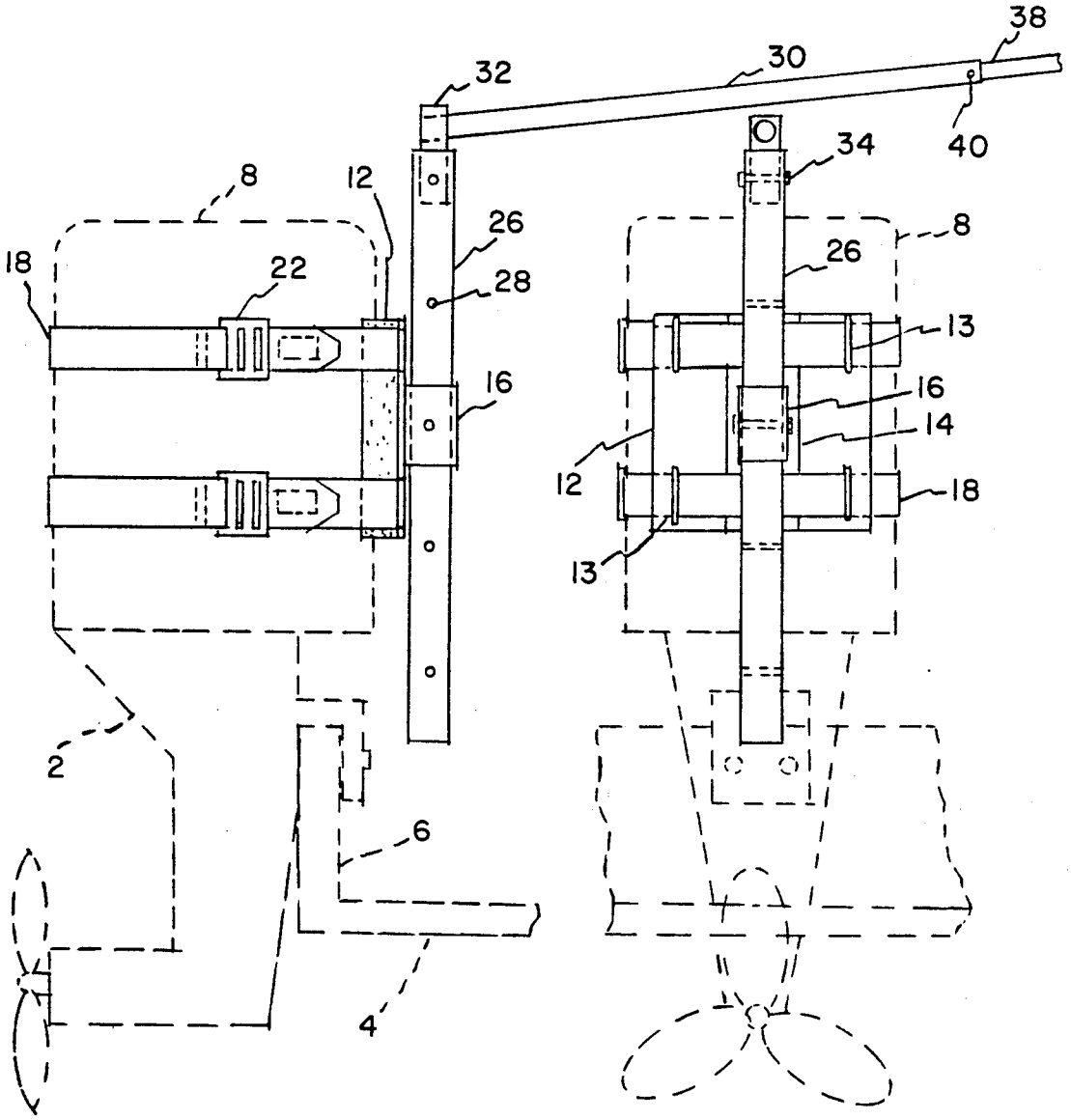
FIGS. 2*a* and *b* are views of an embodiment wherein the emergency tiller is strapped to the forward wall of the motor housing.

Referring to FIGS. 1, 2*a* and *b* and 3 where a typical outboard motor 2 is depicted along with a partial cross section view of an outboard motor boat having a boat hull 4 and transom 6 to which motor 2 and upper housing 8 are attached. A motor housing is a durable cover made of molded fiberglass or equivalent material installed by the manufacturer as a removable protective cover over the outboard engine.

Figure 4A:
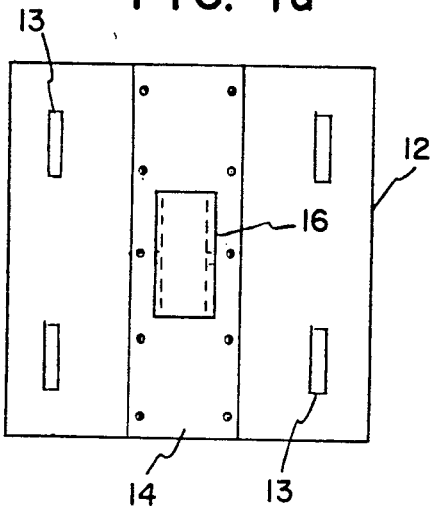
FIGS. 4*a*, *b* and *c* are views of an embodiment of a pad, plate and support socket structure.
Figure 4B:
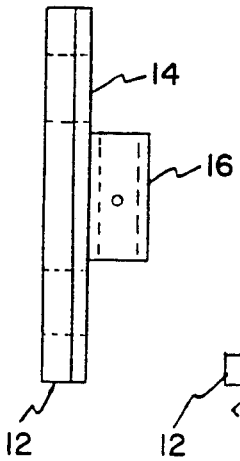
Figure 4C:
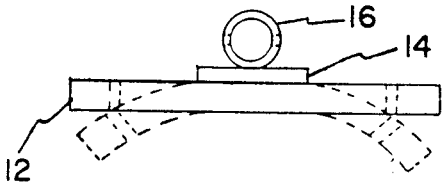

Referring to FIGS. 2*a* and *b* and 3, 4*a*, *b* and *c*, 6*a*, *b* and *c* and 7, embodiments of an emergency tiller mechanism and its components are provided which mechanism is strapped to the motor. In these embodiments, with the exception of FIGS. 5*a*, *b* and *c*, and 6*a*, *b*, *c* and *d*, flexible pad 12 is provided having a durable, compressible, non-slip bottom and a flexible top. Such a preferred pad is shown in FIGS. 4*a*, *b* and *c* wherein the top is polyester or rubber or equivalent material having about 3 plies and a tensile strength of about 135 pounds per inch, and the bottom is compressible corrugated rubber or equivalent non-slip material. A flexible pad found to be satisfactory is about 9 inches long by 9 inches wide by ⅛ inch thick of flexible belting and ⅛ inch thick rubber bottom, that is 3 ply polyester and rubber fabric attached to a compressible, non-slip, corrugated rubber bottom. The flexible belting with the compressible rubber bottom will fit motor housings of various dimensions. Four slots 13 about 2½ inches by ¼ inch 13 are punched through pad 12 as shown in FIG. 4*a* through which straps 18 pass through.

Figure 5A:
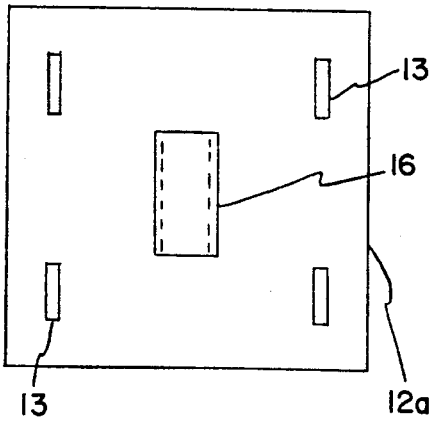
FIGS. 5*a*, *b* and *c* are views of an embodiment of a pad with foam rubber base.
Figure 5B:
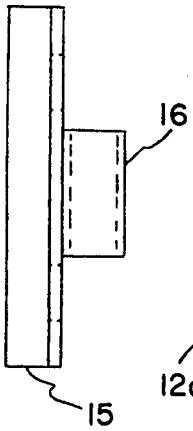
Figure 5C:
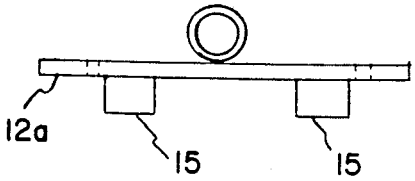
Figure 6A:
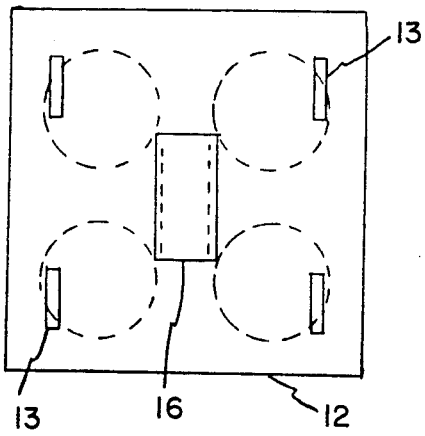
FIGS. 6*a*, *b*, *c* and *d* are views of an embodiment of a pad with rubber suction cups.
Figure 6B:
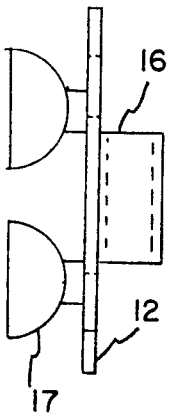
Figure 6C:
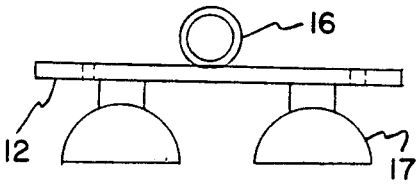
Figure 6D:
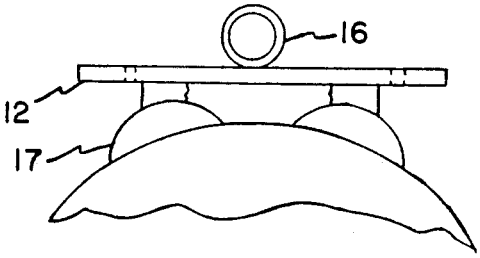

Included in other preferred embodiments of providing a pad with a non-slip surface are one or more pieces of foam rubber 15 or suction cups 17 attached as shown in FIGS. 5*a*, *b* and *c* and 6*a*, *b*, *c* and *d* respectively. Shown further in FIGS. 5*a*, *b* and *c* and 6*a*, *b*, *c* and *d* is an embodiment wherein the foam rubber 15 or suction cups 17 is attached to metal sheet 12*a* to which support socket tube 16 is secured. Preferably, metal sheet 12*a* is an aluminum sheet about 9 inches long by 9 inches wide by ⅛ inch thick. Also shown are slots 13 which straps 18 are to pass through.

Figure 3:
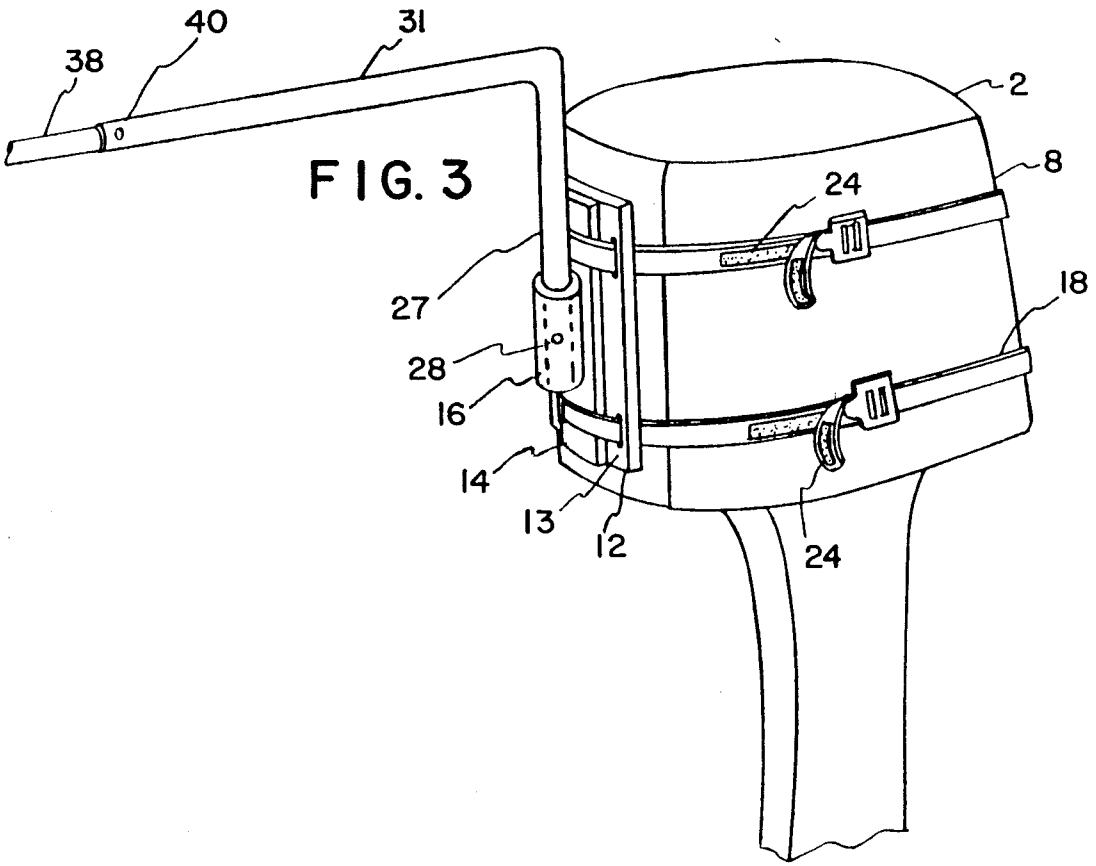
FIG. 3 is a view of an embodiment wherein the emergency tiller has a curved tiller arm.

Plate 14 is secured to the top surface of pad 12 having support socket tube 16 secured to its face as shown in FIGS. 4*a*, *b* and *c*. The securing operations can be performed by rivetting, welding, bolting, adhesive or other appropriate means. The support socket tube 16 is secured to plate 14 by welding, riveting or other means. Pad 12 with plate 14 and support socket tube 16 attached thereto is secured to the forward wall of the upper motor housing by straps 18 as shown in FIGS. 2 and 3. A further extremely efficient embodiment is to strap the mechanism to the top of the motor housing as shown in FIG. 1 which will be discussed below.

Figure 7:
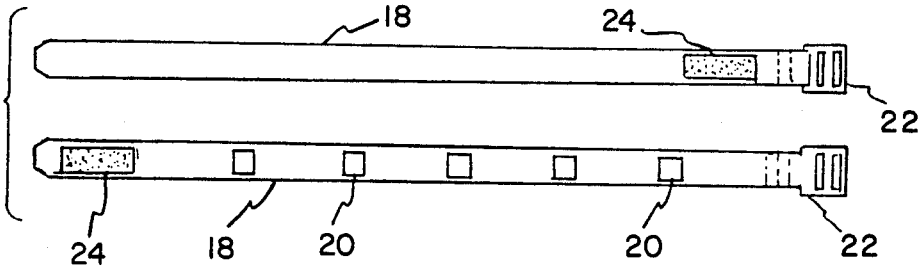
FIG. 7 is a view of an embodiment of a strap assembly.

A pair of straps 18, shown in FIGS. 1, 2 and 3 securing the device to the motor housing, are prepared from strong, durable material having a non-slip underside such as heavy synthetic webbing with a non-slip rubber underside and a suitable tightening mechanism. A suitable strap top and bottom are shown in FIG. 7 having plastic or nylon webbing about 8 feet long and 2 inches wide with non-slip pads about ⅛ inch thick rubber or other non-slip material 20 attached to its underside. The strap further includes a buckle 22 made of aluminum alloy, nylon or other plastic at one end and Velcro contacts 24 or equivalent adhering material at the other end to provide additional holding power to prevent the strap and mechanism from slipping. As shown in FIGS. 1, 2 and 3, each strap passes through two aligned slots 13, across pad 12, plate 14, around upper motor housing 8 and through buckle 22 to be tightened. Generally, the strap should have a tensile strength of at least 300 pounds per inch.

Referring to FIGS. 2*a* and *b*, an embodiment shows verticle arm component 26 securely mounted within hollow socket tube 16. Support socket tube 16 may be of any size and dimensions to adjustably accomodate and firmly support vertical arm component 26 which snugly fits within its interior and can be moved up and down. As shown, arm component 26 is adjustably secured by means of bolts, locking pins or equivalent securing means through holes 28 to the required height. Adjusting of the height of arm component 26 allows horizontal tiller arm 30 and extension tiller arm 38 to clear high decks, rails, seats or other obstacles to tiller arm steering found on some boats. It is noted, however, that a non-adjustable tiller arm system wherein arm component 26 is non-adjustably secured to support socket tube 16 results in an extremely efficient mechanism which is a less expensive than the adjustable verticle arm component and is similar to tiller arm mechanism configuration as shown in FIG. 3.

In the embodiment of FIGS. 2*a* and *b*, horizontal tiller arm 30 is attached to the distal end of arm component 26 through connecting tube 32 and extends at a horizontal or slight upward angle within the cockpit of the boat. Tiller arm 30 is attached to connecting tube 32 such as by welding, bolting or adhesive or equivalent means and connecting tube 32 is secured to arm component 26 by bolt 34 pin or similar securing means. Tiller arm 30 is usually long enough to comfortably maintain the steering of the boat. A satisfactory horizontal tiller arm mechanism is a tiller arm 30 which is about 30 inches in length secured to a 3 inch long post tube 32 secured to the distal end of the arm component 26.

FIG. 3 shows a preferred embodiment of the emergency tiller mechanism similar to that shown in FIG. 2 except that the tiller arm system is prepared from one piece of material bent to extend horizontally or at a slight upward angle within the cockpit of the boat. As shown, verticle arm component 27 is secured within support socket tube 16 by a bolt or pin through hole 28 and bends horizontally as tiller arm 31 into the cockpit of the boat. This bent tiller arm system is extremely efficient and economical. The height of verticle component 27 and the length of horizontal component 31 are set to accomodate the individual steering requirements of the particular boat.

Extension tiller 38 may be inserted within the handle end of horizontal tiller arm 30 or 31 otherwise connected thereto to increase the overall length of the tiller as required. Extension tiller 38 may be secured to tiller arm 30 or 31 when extended by matching up holes 40 in each arm through which a securing means is then attached such as by inserting a bolt with nut, locking pin or equivalent means therein as shown in FIGS. 2 and 3. Extension tiller arm is particularly required on boats wherein the outboard motor is mounted considerably aft of the boat's transom whereby an extra long tiller is required.

FIG. 1 shows an embodiment which is similar to those of FIGS. 2*a* and *b* and 3 except that the emergency tiller system is strapped to the top wall of the motor housing and the two nylon straps are passed under upper motor housing 8 to tighten the non-slip pad 12 against the motor housing. Horizontal tiller arm 33 is secured to support socket tube 16 as shown and extends horizontally or at a slight upward angle within the cockpit of the boat. Tiller extension arms 38 further extends the tiller within the cockpit.

FIGS. 8*a, b* and *c* are directed to an embodiment similar to that of FIG. 1 except that plate 14 with support socket tube 16 attached thereto is secured directly to upper motor housing 8 such as by bolts and nuts, welding, adhesive or similar means. A tiller system which works successfully is composed of a plate about 4 inches by 5 inches by ⅛ inch secured to round support socket tube 16 about a 1½ inches by ⅛ inch by 4 inches with or without wedge spacer 42 wherein the plate is bolted to the top wall of upper motor housing 8 with about six 3/16 inch bolts with locking nuts. However, the support socket tube and plate can be a one piece mechanism prepared by a metal casting or a plastic molding operation. Tiller arm 33 preferably composed of a long round tube about 1⅛ inches by ⅛ inch by 30 inches long is secured within said support socket tube 16 by ¼ inch by 2 inches bolt with locking nut or locking pin or similar means. Attached thereto is preferably a round extension tiller arm 38 about ¾ inch by 0.100 inch by 33 inches long secured to tiller arm 33 with a ¼ inch by 1½ inches bolt with nut or locking pin or similar means.

FIGS. 9*a, b* and *c* are directed to an embodiment similar to that shown in FIGS. 8*a, b* and *c* except that plate 14 with support socket tube 16 attached thereto is secured to the vertical forward side of upper motor housing 8 having bent tiller arm mechanism secured within support socket tube 16 component 27 whereby extends vertically and then horizontally or at a slight upward angle as tiller arm 31 into the cockpit and connecting tiller extension arm 38.

Figure 10A:
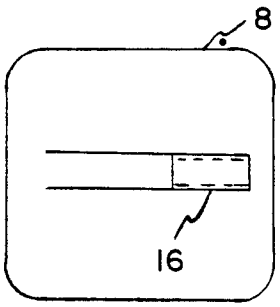
FIGS. 10*a*, *b*, *c*, *d*, *e* and *f* are views of an embodiment wherein the support tube is an integral part of the motor housing.
Figure 10B:
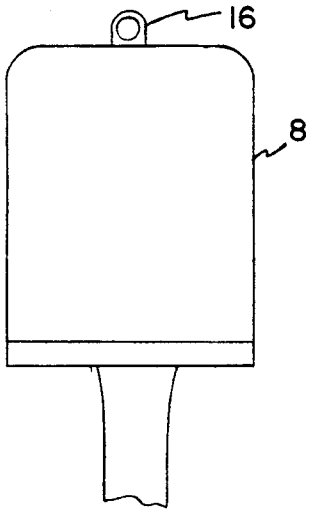
Figure 10C:
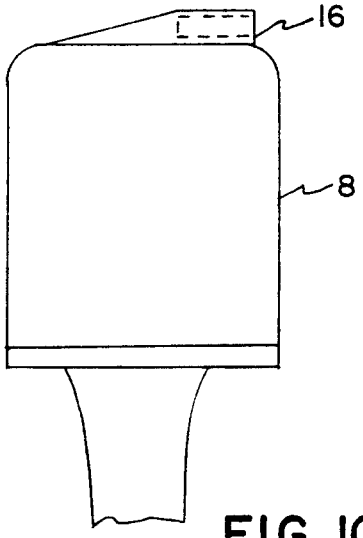
Figure 10D:
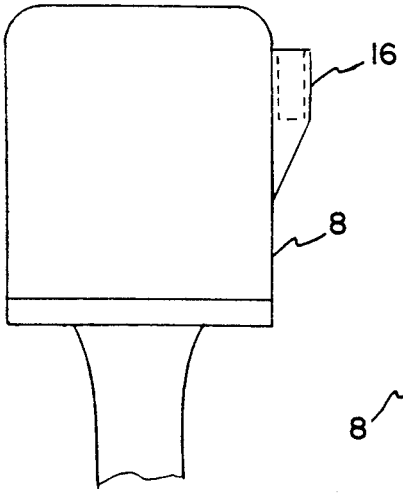
Figure 10E:
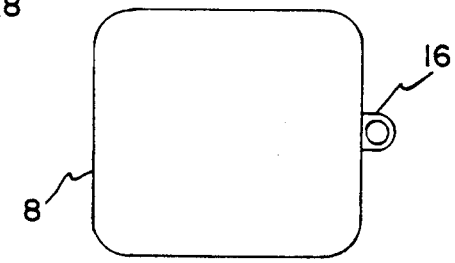
Figure 10F:
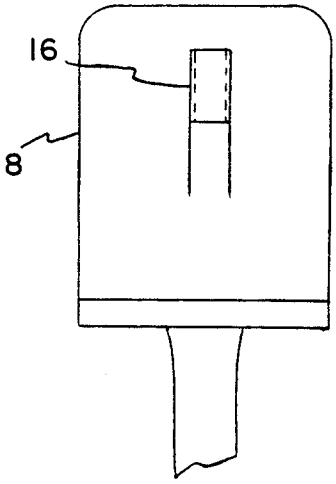

FIGS. 10*a, b, c, d, e* and *f* depict support socket tube 16 formed, molded or cast as an integral unit in outboard motor upper housing 8 to allow securing of the tiller arm mechanism as previously described. Support socket tube 16 can be molded or cast externally to the outside housing surface or embedded otherwise therein.

The emergency tiller of the invention may be prepared from metals such as aluminum, from plastic, rubber, wood or other suitable materials and have appropriate dimensions and configuration to satisfactorily accomplish the desired result.

The emergency tiller mechanism of the invention is not intended for permanent installation but to be used when the steering fails. It is safe and easy to use at motor speeds up to about 2000 RPM.

While particular embodiments of the invention have been illustrated and described, it will be apparent to those skilled in the art that various changes and modifications can be made without departing from the spirit and scope of the invention.

What is claimed is:

1. An alternate emergency steering mechanism for use in combination with an outboard motor attached to a boat as its principal power source and rotatable about a steering axis by a tiller arm, said motor enclosed within an upper motor housing and steered by a cable or hydraulic steering system, said alternate steering mechanism comprising:

an open tube socket means with mounting means to manually mount on a wall of said motor housing without the use of tools, a tiller arm means adapted to be releasably secured within the interior of said socket means and to extend horizontally within the interior of the boat at, or above, the height of the motor housing, securing means for releasably securing said tiller arm means to said socket means, whereby said tiller arm means controls the steering of the boat when said cable or hydraulic steering system fails.

2. A steering mechanism according to claim 1 whereby said tiller arm means is adapted to extend horizontally at a slightly upward angle within the interior of the boat.

3. A steering mechanism according to claim 1 whereby said socket means is joined to a plate or sheet means which is joined to said housing.

4. A steering mechanism according to claim 3 whereby said plate means is joined to a flexible non-slip pad means which is joined to said housing.

5. A steering mechanism according to claim 4 whereby said pad means is joined to said housing by a pair of non-slip strap means encircling said housing.

6. A steering mechanism according to claim 5 whereby said strap means pass through slot openings at opposite sides of said pad means.

7. A steering mechanism according to claim 6 whereby said pad means comprises a non-slip compressible rubber bottom attached to a polyesterrubber fabric base.

8. A steering mechanism according to claim 7 whereby said fabric has a tensile strength of about 135 pounds per inch.

9. A steering mechanism according to claim 6 whereby said strap means comprises a plastic or nylon webbing having non-slip pad means joined to its bottom surface, a buckle at one end and an adhesive attachment at its other end.

10. A steering mechanism according to claim 9 whereby said strap means has a tensile strength of at least 300 pounds per inch.

11. A steering mechanism according to claim 3 whereby said sheet means is a metal sheet.

12. A steering mechanism according to claim 11 whereby said sheet is an aluminum sheet.

13. A steering mechanism according to claim 12 whereby said aluminum sheet has a foam rubber bottom means attached thereto.

14. A steering mechanism according to claim 12 whereby said aluminum sheet has suction cup means attached thereto.

15. A steering mechanism according to claim 1 whereby said socket means is joined to the top wall of said motor housing and said tiller arm means comprises a relatively straight tiller arm means extending horizontally within the boat.

16. A steering mechanism according to claim 15 whereby an extension tiller arm means is joined to the end of said straight tiller arm means.

17. A steering mechanism according to claim 16 whereby said tiller arm means extends horizontally at a slight upward angle.

18. A steering mechanism according to claim 1 whereby said tube socket means is joined to the forward wall of said motor housing and said tiller arm means comprise a vertical arm component means joined to said socket means and a horizontal tiller arm means joined to said vertical arm component means extending within the boat interior.

19. A steering mechanism according to claim 18 whereby said tiller arm means comprises one tiller arm extending vertically and bent horizontally.

20. A steering mechanism according to claim 18 whereby said vertical component means and said horizontal tiller arm means are mechanically joined together.

21. A steering mechanism according to claim 20 whereby said horizontal tiller arm means is joined to said vertical component means through a connecting means joined to the top of said vertical component means.

22. A steering mechanism according to claim 21 whereby said horizontal tiller arm means is permanently joined to said vertical component connecting means which is releasably joined to the top of said vertical component means.

23. A steering mechanism according to claim 21 whereby said vertical component means is adjustably joined to said socket means whereby it can be moved up and down to various heights.

* * * * *